United States Patent [19]

Hart

[11] Patent Number: 4,652,868

[45] Date of Patent: Mar. 24, 1987

[54] MULTI-CHANNEL FAULT MONITOR USING QUICK-ACTING INTERFACES TO OPERATE SLOW-ACTING INDICATORS

[75] Inventor: Robert D. Hart, Collinsville, Conn.

[73] Assignee: Minelco, Inc., Thomaston, Conn.

[21] Appl. No.: 722,487

[22] Filed: Apr. 12, 1985

[51] Int. Cl.[4] ..... G08B 21/00

[52] U.S. Cl. ..... 340/691; 340/501; 340/815.05

[58] Field of Search ..... 340/691, 815.05, 815.08, 340/815.09, 501; 361/170, 194; 334/234, 229, 79

[56] References Cited

U.S. PATENT DOCUMENTS

| | | | |
|---|---|---|---|
| 2,836,773 | 5/1958 | Skrobisch | 335/229 |
| 3,480,938 | 11/1969 | Martin | 340/691 |
| 3,543,202 | 10/1970 | Naybor | 335/229 |
| 3,936,818 | 2/1976 | Skrobisch | 335/229 |
| 4,399,434 | 8/1983 | Bielat | 340/691 |

*Primary Examiner*—Glen R. Swann, III

*Attorney, Agent, or Firm*—Pennie & Edmonds

[57] ABSTRACT

An indicator for monitoring a channel fault is located in each channel of a multichannel system. An interface is located between each indicator and channel being monitored to assure a response of the indicator under circumstances that a fault signal in the channel could not have otherwise activated the indicator.

7 Claims, 3 Drawing Figures

LATCH
VDD
VSS
(+)
(-)

MULTI-CHANNEL FAULT MONITOR USING QUICK-ACTING INTERFACES TO OPERATE SLOW-ACTING INDICATORS

TECHNICAL FIELD

The invention is in an indicator responsive to a fault signal in a monitored channel to provide an indication of the occurrence of a fault, and an electrical interface to assure response of the indicator under circumstances that the fault signal could not have otherwise activated the indicator.

BACKGROUND OF THE INVENTION

Indicator mechanisms having electrically controlled magnetic movements, which may be housed in small housings and readily mounted on a panel for a variety of purposes are known in the prior art. A representative sampling of prior art devices of this type may be seen in U.S. Pat. Nos. 2,836,773 and 3,936,818, both to Alfred Skrobisch ("Skrobisch 1 and 2") and 3,543,202 to Edward V. Naybor. Each patent generally discloses a rotor in the form of a permanent magnet, which may be a magnet in disc form (Skrobisch 1 discloses that the permanent magnet may be either a bar magnet or a magnet in disc form) and a stationary electromagnet.

Skrobisch 1, more particularly, discloses a device which requires only negligible power for operation of the movement (the magnet) which includes indicator indicia in the form of coated surfaces on the magnet, such as a black and white coating throughout sectors of the surface to indicate a normal or abnormal condition at a viewing window. The magnet does not latch in the energized orientation, but, rather, returns to the unenergized orientation when the operating power is discontinued.

Naybor discloses a somewhat similar device which is responsive to short duration direct current pulses, described as at least 15 milliseconds (ms) in length, and functions in a manner to latch thereby to maintain the last position achieved. Thus, Naybor discloses a bistable type of device wherein the permanent magnet which functions as a visual indicator presents one of two possible aspects.

Skrobisch 2 discloses a device, like that of Skrobisch 1 and Naybor, wherein the indicator device is in the form of an assembly including a plurality of permanent magnets and a stator subassembly providing a plurality of stationary electromagnets. Skrobisch 2 describes that the permanent magnets are arranged to latch in either one of two positions, or they may operate without latching.

SUMMARY OF THE INVENTION

The present invention overcomes what may be considered as a significant problem in each of the prior art references above, namely that the indicator which is to provide the indication of a fault condition may not respond to the fault signal. Particularly, devices of the type heretofore described will not respond unless the fault signal continues throughout some minimum time duration. The Naybor device, for example, requires a fault signal of at least 15 ms duration. Thus, the Naybor device will not respond to a fault signal of a time duration less than 15 ms, and such a fault signal will go undetected and unnoticed.

It is important in many applications for a fault signal of extremely short time duration, for example 1 microsecond (μs) time duration or even less, to cause a response in an indicator. The inertia of the indicator device will prevent a response under these circumstances, and it has been suggested by Naybor that the time duration of the fault signal must be at least 15 ms.

The invention is in an indicator responsive to a fault signal in a monitored channel to provide an indication of the occurrence of a fault and an electrical interface to assure that the indicator will respond to the fault signal even if the fault signal is of an extremely short time duration. Very broadly, either a single indicator or a plurality of indicators to respond to a plurality of channels to be monitored may be controlled by the electrical interface that functions to respond to an input fault signal and latch that signal for the duration of time required to permit the indicator to indicate the fault. The latch which may function as an AND gate provides a continuous enabling voltage output. A switch in the form of a transistor array, activated by an output of the latch, permits current to flow from a source, through a "set" coil of the indicator, to energize the particular indicator and provide a fault indication for the channel being monitored. The electrical interface also includes a circuit to "reset" the indicator and to "reset" the latch that shall have responded to the fault signal.

BEST MODE FOR CARRYING OUT THE INVENTION

The invention is in an electrical interface between each of several isolated channels and the combination of an output indicator which will respond to a fault condition along a channel. Particularly, the electrical interface functions in a manner to latch the output indicator under circumstances otherwise insufficient to attain that result. Typically, an output indicator of the type to be described will take perhaps 20 ms to operate. The electrical interface, however, will provide operation through a latching capability in response to an input fault pulse along any channel on the order of 1 μs or even less . It follows, absent the latching capability of the electrical interface, that a short duration fault pulse, such as a pulse of a time duration of 1 μs, would be unable to operate the respective output indicator. Thus, the desired information sought in systems where intermittent short duration fault pulses may exist would go undetected.

Figure 1:
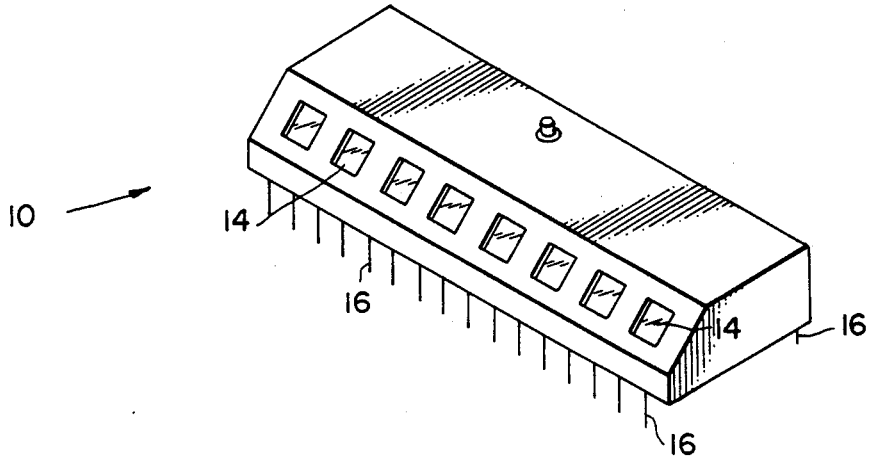
FIG. 1 is a perspective view of a casing module for housing the indicator of the invention.
Figure 2:
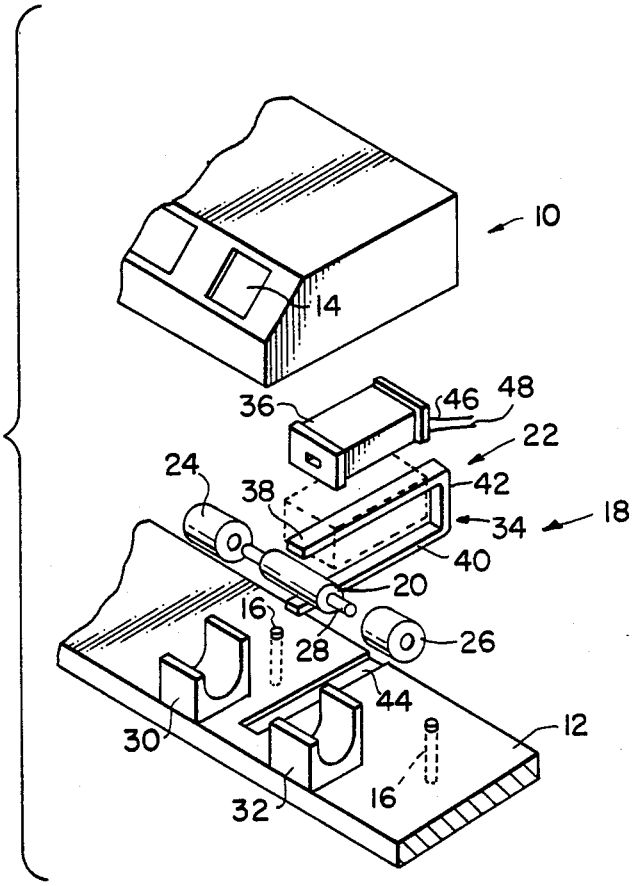
FIG. 2 is a partial perspective view of the indicator and casing with the components exploded apart.

The casing module 10, see FIG. 1, will be of a type to receive a base 12, see FIG. 2, such as a standard 40-pin base. Typically the casing module may be formed of plastic, such as a molded polyester, and it will include a viewing wall having a plurality of windows 14. Each window may be of a high temperature polyamide material. In the embodiment of the invention to be described eight windows are formed in an offset portion of the front wall of the casing module, one for each channel being monitored.

The casing module 10 may be about two inches in length, about three-eighths inch in height and about three-quarters inch in width. As may be seen in FIG. 1, pins 16 extend from the base 12, outwardly of the casing module in an array of two rows of twenty pins in each row. Each pin is of standard length and diameter. Typically, the rows of the array are spaced apart at 0.600 inch spacing and the pins are arranged on 0.100 inch centers. The module is compatible with standard mircroprocessor equipment.

Figure 3:
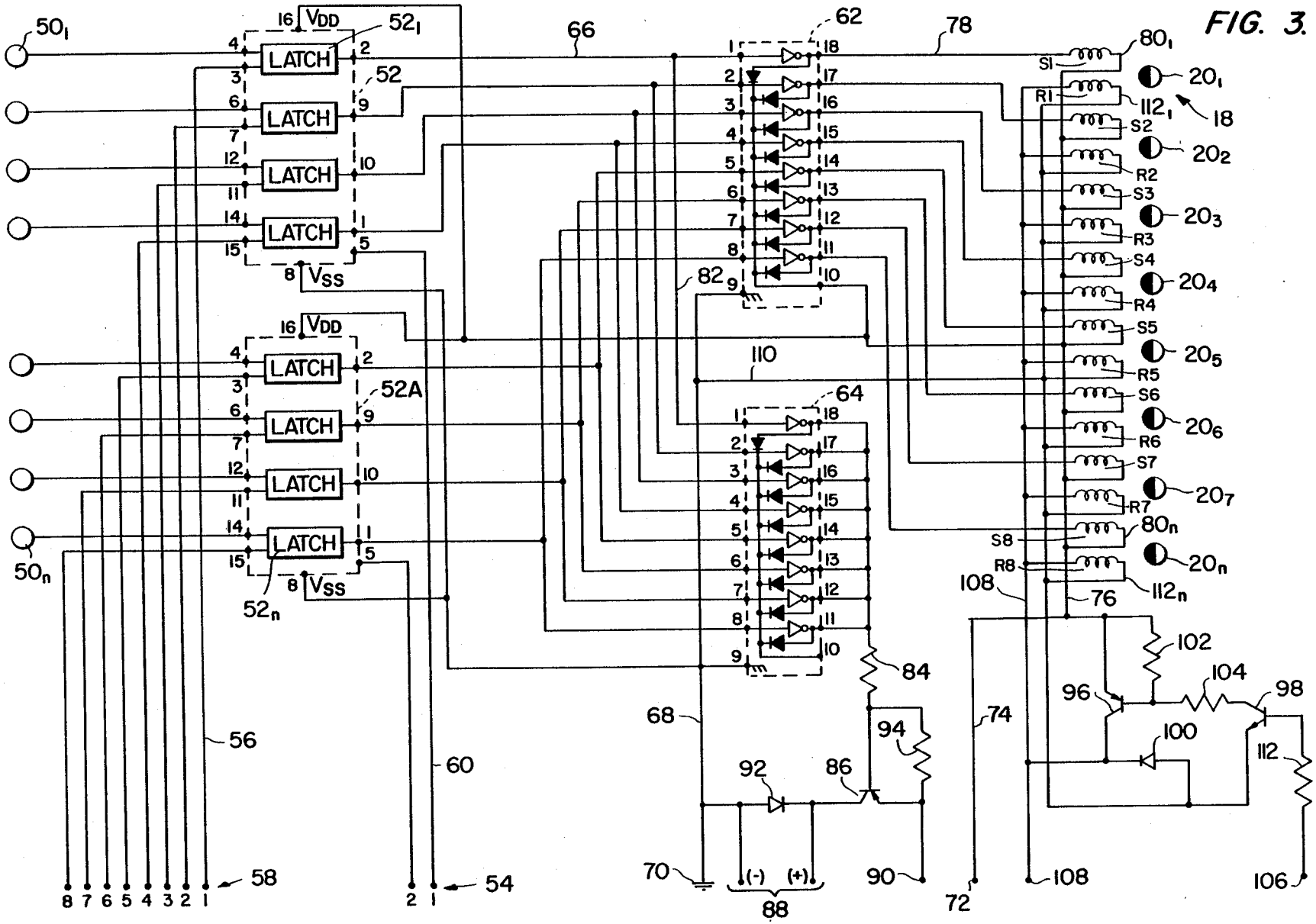
FIG. 3 is a schematic of an electrical interface.

An output indicator 18, seen schematically in FIGS. 2 and 3, monitors each channel. According to the characterization of the casing module, it may be appreciated that each output indicator is of small size, and it is light in weight. The output indicator has the capability of being mounted on base 12, which may be a printed circuit board, and it is of low power design. The output indicator includes a permanent magnet 20 and an electromagnetic assembly 22, and it provides a non-volatile display.

The permanent magnet is illustrated in the form of a disc or drum, magnetized radially. The permanent magnet may be supported for rotation in a pair of spaced bearings 24, 26. To this end, the magnet is mounted on a stub shaft 28 for conjoint rotation. A pair of bearing mounts 30, 32 are illustrated supported on base 12. It is also envisioned that the magnet may rotate freely on the stub shaft, thereby to obviate the requirement of a bearing. In this form of the invention, which may be preferred, the stub shaft may be fixed to a pair of supports (not shown) spaced apart in a manner similar to the spacing of the bearing mounts 30, 32. The stub shaft may be glued or cemented to each support.

The permanent magnet 20 may be formed of any conventional material, such as Alnico,Barium Ferrite or an equivalent alloy or material. As indicated, the permanent magnet is magnetized radially with N and S poles spaced 180° apart. In FIG. 3, the north pole may be characterized by the magnet top color seam of the presentation, and the south pole may be characterized by the magnet bottom color seam of the presentation. The indicator, thus, will provide a clear indication of a change in condition and that change in condition may be seen with excellent wide angle visibility under high ambient light conditions.

Referring again to FIG. 2, it may be seen that the electromagnetic assembly 22 includes a stator 34 and a coil 36. The stator is formed by a U-shaped core including a pair of legs 38, 40 which extend from a web portion 42. One leg of the stator, for example, the leg 40, is received in a channel 44 cut in base 12 and serves to mount the stator relative to the base and permanent magnet. As illustrated by the dash line, coil 36 is received about the leg 38. The stator is formed of a ferrous material and the core is temporarily but not permanently magnetized by current flowing in the winding of the coil thereby to attract or repel a pole of the permanent magnet. Movement of the permanent magnet to a latched position may be appreciated by a display in one of the viewing windows 14.

The lead wires 46, 48 each may be connected to a pin 16 which extends from base 12. As will become more clear from the discussion directed to FIG. 3, coil 36 is a dual bifilar wound coil having one winding for a "set" operation and the other winding for a "reset" operation.

As apparent from FIG. 1, the output indicator 18 of FIG. 2 is replicated along the base 12 for use in a multichannel electrical system. Eight-channels, each including a separate output indicator having a permanent magnet, electromagnetic assembly, "set" and "reset" windings, and so forth, are illustrated for the sake of discussion. However, it should be obvious that greater or fewer channels could be monitored.

Referring to FIG. 3, there is illustrated an eight-channel electrical interface for monitoring a fault pulse, which may be intermittent and which may be of short time duration for controlling the output indicator 18 represented in the Figure by the numerals $20_1$, $20_2$, and so forth for the respective channels. Each channel input is designed for minimum loading of preceeding circuits and is compatible with low power TTL outputs. The electrical interface is designed to be enclosed in the casing module 10. The casing module may provide an hermetic enclosure to maintain dust free conditions of operation of each output indicator 18.

A fault may occur along a line connected at an input $50_1$, comprising one of a plurality of inputs $50_1 \ldots 50_n$. If that fault signal is of sufficient magnitude and duration the likelihood that an indicator will respond to the fault signal is good. However, if the fault signal is not of sufficient magnitude and duration it is possible that the fault signal will go undetected. With regard to time duration, it was heretofore stated that indicators typically may take about 15 ms, possibly longer, to operate, and therefore require a fault signal of that duration for operation. According to the invention, a fault signal of less duration, for example, a fault signal of about 1 $\mu$s will be sufficient to provide operation of the output indicator.

Since the operation of each channel connecting with the inputs $50_1 \ldots 50_n$ is the same, the description will consider the operation of the electrical ihterface under circumstances that a fault signal exists along the channel connecting with input $50_1$.

A fault signal at input $50_1$ and pin 4 of latch $52_1$, having a pulse duration of 1 $\mu$s will cause the output of the latch at pin 2 to go to a positive value voltage equal to the supply voltage, provided enabling input 54 is activated and under circumstances that the input at pin 3 of the latch is zero. Pin 3 is connected by connector 56 to reset input 58 providing a separate reset input to each latch $52_1 \ldots 52_n$. Connector 56 is connected to terminal 1 of reset input 58.

The enabling input 54, either from terminal 1 or 2, may be connected to a 6-volt DC source and terminal 1 is connected by connector 60 to pin a of an integrated circuit 52, identified as CD4043BH. The integrated circuit is a COS/MOS Quad 3-State R/L Latch, a product of Radio Corporation of America, and described in File No. 590, November 1973, pages 214–219. Reference may be had to the technical bulletin to be incorporated herein by reference.

A transistor array 62 and a second transistor array 64, each including an eight-channel input, are connected directly to individual output terminals of latches $52_1 \ldots 52_n$ of integrated circuit 52 and a second integrated circuit 52A. The transistor arrays each may be a high-voltage, high-current Darlington transistor array, identified ULS2803C of the Sprague Electric Company. Reference may be had to the Sprague technical literature relating to the Series ULS-2800 M and ULS2800 R transistor arrays, pages 4–60 through 4–70 for a full description of their operation. The technical literature is incorporated herein by reference.

Connectors 66, 82 connect the output (pin 2) of latch $52_1$, and the input (pins 1) of the transistor arrays 62, 64. Under circumstances of a positive voltage at these inputs the transistor arrays will conduct. To this end, the drivers of the transistor arrays connected to the positive output along conductors 66, 82, which theretofore were in open circuit condition, will be connected to ground. Connector 68 provides the ground connection to pin 9 of each array. The ground connection is indicated at 70. Current from an external power supply, at connection 72, will flow through the circuit path provided by connectors 74, 76 and 78, and return to ground 70 through connector 68. The current flow will "set" coil array $80_1$ (indicated in FIG. 3 as "S1"). The grounded coil array will be energized and the flux will cause magnet $20_1$ to rotate about its axis to present, for example, the white opaque surface to a viewing window 14. As such, a fault will be recognized to have existed in the channel connecting with input $50_1$.

The external power supply at connection 72 may be a 6 volt DC supply. The output along connector 66, and the connector 82, is simultaneously recognized at the input of both transistor arrays 62, 64 (pin 1). Transistor array 64 will likewise be grounded in the fashion heretofore described. Upon the grounding of the transistor array 64, the voltage across resistor 84 on the side toward the transistor array will drop, resulting in a change in potential at the base of the transistor 86. Current will thus flow through the external indicator circuit 88. Each output of transistor array 64, including the outputs at pins 11, 12 . . . 18, is directly connected to resistor 84, and similar operation will follow a fault signal at any one of the inputs $50_1 \ldots 50_n$.

The external indicator circuit may be any form of electronics which will indicate the presence of a fault along any or all of the channels being monitored at the inputs $50_1 \ldots 50_n$. The external indicator may be reset electrically or manually, as may be expedient. The external indicator circuit may be traced from connection 90, providing an indicator voltage source, through the emitter-collector junctions of transistor 86, through the external indicator 88 in parallel with diode 92, to ground 70.

Resistor 84 may be a 1200 ohm resistor, transistor 86 may be a 2N2907A transistor and diode 92 may be a 1N4448 diode or the equivalent. The diode 92 will prevent a possible back-spike, which may be characterized by an excessively large voltage following a signal pulse from transistor 86 developing across the external indicator. Such a back-spike, should it occur, would possibly damage the transistor. Resistor 94 which may be a 2700 ohm resistor serves to provide a bias voltage for transistor 86.

The electrical interface providing an electronic switch for reset of the indicators now will be described. The electronic switch comprises transistors 96, 98, a diode 100 and resistors 102, 104, all in the form of a PNP, NPN amplifier. Transistor 96 may be a 2N4033 transistor, transistor 98 may be a 2N3019 transistor, diode 100 may be a 1N4448 diode or the equivalent and resistors 102, 104 may be a 1000 ohm and 100 ohm resistor, respectively. All resistors may have a 10% tolerance factor.

A reset pulse may be applied at connection 106. The reset pulse may originate at a control station and will reset all indicators $20_1 \ldots 20_n$ as may have been energized to indicate a fault signal. The reset pulse at the base of transistor 98 causes transistor 96 to conduct and apply a reset voltage between the voltage source at connection 72 and ground 70. The connection is completed along connectors 108, 110 and 68, through each of the several reset coils $112_1 \ldots 112_n$ arranged in parallel. The reset pulse may be a positive 20 ms pulse or the reset pulse may be a straight DC level, as choice dictates. The input at the electronic switch is of high impedence character and will not load TTL circuitry. Transistor 96 will conduct upon an input to transistor 98 of at least 0.4 milliamps. The resistors 102, 104, as well as resistor 112 which may be a 2200 ohm resistor, provide proper bias of the transistor 96, 98. The diode 100, as well as the diodes of the transistor arrays 62, 64, provide a protective function against excessively large voltage surges.

The reset input 58 also may receive a signal from a control station. As previously discussed, the reset input, including a separate input to each latch $52_1 \ldots 52_n$, will provide a reset impulse signal to reverse or reset the condition of a latch theretofore activated by a fault signal to the latch condition. If, for example, the reset impulse signal is applied to any latch at the time a fault signal occurs at the input to the latch, the indicator $20_1 \ldots 20_n$ will respond, but only under the condition that the fault signal is of sufficient duration and of a voltage required by the indicator for operation. By this means, the circuit may be electronically adjusted to accept and act upon very short pulses, or the circuit may be set to accept pulses having a duration of greater than 20 ms depending upon the operate time of the output electromagnetic indicator. Thus, some percentage, such as one-half of the indicators may be set to respond to short pulses and the remaining indicators may be set to respond to longer pulses. The longer pulses may have a duration of greater than 20 ms.

The system may provide a visual capability output, at indicators $20_1, 20_2 \ldots 20_n$, in the form of a binary count. Thus, the indicators $20_1, 20_2 \ldots 20_6$ may serve as a 32-bit word, and the indicators $20_1 \ldots 20_n$ may serve as the next bits, representing sixty-four, one hundred twenty-eight, and so forth. If one color represents one binary number code, and the other color represents the other binary number code, then a particular signal at the inputs $50_1\ 50_2 \ldots 50_n$ will induce a change in the angular condition of the magnet to provide a visual observation of a binary count.

I claim:

1. a system for monitoring a channel and indicating a fault signal in said channel having a time duration less than that of the response time of an indicator connected to the channel for responding to and providing an indication of the existance of said fault signal comprising an electrical interface connecting said channel and said indicator, said electrical interface including latch means adapted to provide a continuous voltage output upon application of an enabling source when said latch means is in a set condition, and switch means controlled by said continuous voltage output of said latch means for closing a normally opened circuit through a "set" coil of said indicator, said circuit through said "set" coil providing an electrically connection between ground and a voltage source to control said indicator from a first to a second position.

2. The system of claim 1 including a plurality of channels adapted to be monitored by a like plurality of indicators, via a like plurality of corresponding electrical interfaces and wherein each said electrical interface connects a channel to a corresponding indicator whereby each indicator responds to the corresponding channel.

3. The system of claim 1 or 2 including means to reset each said latch.

4. The system of claim 1 or 2 wherein each said indicator has a first and second stable operating position, each said indicator being controlled by a "set" coil to said second operating position, and further including reset means for controlling each said indicator from said second to said first operating position.

5. The system of claim 1 or 2 wherein said latch means comprise an AND gate, and including means for setting said latch means whereby a fault in a channel will cause said latch means to provide said continuous voltage output.

6. The system of claim 1 or 2 wherein said switch means comprise a transistor array including a driver connected to the output of said latch and responsive to said continuous voltage, and wherein said circuit, through said "set" coil, includes said transistor array.

7. The system of claim 2 adapted for use as a visual binary counter wherein a sequential series of indicators may serve as an n-bit word, while the next and subsequent sequential series of indicators may serve as additional n-bit words.

* * * * *